US006098997A

United States Patent [19]

Cheng

[11] Patent Number: 6,098,997

[45] Date of Patent: Aug. 8, 2000

[54] IN-LINE ROLLER SKATE WITH TWO-PIECE FRAME FOR WHEELS

[76] Inventor: Tsan-Hsiung Cheng, No. 1051, Lung-Tien, Lung-Pen Tsun, Kuan-Tien Hsiang, Tainan Hsien, Taiwan

[21] Appl. No.: 09/126,080

[22] Filed: Jul. 30, 1998

[51] Int. Cl.[7] ..... A63C 1/00

[52] U.S. Cl. ..... 280/11.28; 280/11.19; 280/11.22; 280/11.27

[58] Field of Search ..... 280/11.19, 11.22, 280/11.27, 11.28, 11.3, 87.042, 636, 842, 843

[56] References Cited

U.S. PATENT DOCUMENTS

| | | | |
|---|---|---|---|
| 4,932,675 | 6/1990 | Olson et al. | 280/7.13 |
| 5,348,321 | 9/1994 | Sbrilli | 280/11.22 |
| 5,421,596 | 6/1995 | Lee | 280/11.19 |
| 5,484,149 | 1/1996 | Lee | 280/11.26 |
| 5,524,912 | 6/1996 | Laub et al. | 280/7.13 |
| 5,533,740 | 7/1996 | Lin | 280/11.22 |
| 5,690,344 | 11/1997 | Chen | 280/11.28 |
| 5,704,620 | 1/1998 | Oliemans et al. | 280/11.22 |
| 5,730,467 | 3/1998 | Huang | 280/843 |
| 5,732,958 | 3/1998 | Liu | 280/11.22 |
| 5,803,466 | 9/1998 | Wrike | 280/7.13 |
| 5,876,044 | 3/1999 | Yin | 280/11.22 |
| 5,879,019 | 3/1999 | Mantel | 280/620 |
| 5,890,724 | 4/1999 | Gignoux et al. | 280/11.28 |
| 5,904,360 | 5/1999 | Oliemans et al. | 280/11.28 |
| 5,918,889 | 7/1999 | Tai | 280/11.22 |
| 5,921,573 | 7/1999 | Challande et al. | 280/636 |
| 5,961,131 | 10/1999 | Hilgarth | 280/11.22 |
| 5,979,916 | 11/1999 | Gatel et al. | 280/11.22 |
| 5,992,861 | 11/1999 | Piotrowski | 280/7.14 |

*Primary Examiner*—Eric Culbreth
*Assistant Examiner*—L. Lum
*Attorney, Agent, or Firm*—Dougherty & Troxell

[57] ABSTRACT

A in-line roller skate having a front wheel frame and a rear wheel frame respectively pivoted to the sole of the boot thereof by rivets and arranged in a line to hold a respective pair of longitudinally aligned wheels, a brake pad selectively fastened to the front wheel frame or rear wheel frame, and two ball socket shells respectively mounted in receiving troughs on the wheel frames, the ball socket shells each holding two steel balls in close contact with the sole of the boot, allowing the wheel frames to flex with sole when the roller skate is tilted to change its skating direction. Flanges and notches are respectively provided at the wheel frames and the sole of the boot to act against the ball socket wheels and to limit the deviating angle of the wheel frames.

3 Claims, 13 Drawing Sheets

IN-LINE ROLLER SKATE WITH TWO-PIECE FRAME FOR WHEELS

BACKGROUND OF THE INVENTION

The present invention relates to a in-line roller skate, and more particularly to such a in-line roller skate which comprises two wheel frames respectively pivoted to the sole of the boot thereof by rivets to hold a plurality of wheels in a line, two ball socket shells mounted in receiving troughs on the wheel frame to guide the turning of the wheel frames about the respective rivets, and means to limit the turning angle of the wheel frames relative to the boot.

In conventional roller skates, wheels are arranged in pair. When skating, the wheels are moved along two parallel skating lines (see FIG. 2). Because of much contact area between the wheels and the ground, much resistance is produced when skating on a conventional roller skate. Further, the wheels of a conventional roller skate may be struck with stones or foreign objects during skating. Therefore, it is difficult to make a smooth skating on a conventional roller skate. Recently, in-line roller skates have become more and more popular for the advantages of high performance. A in-line roller skate, as shown in FIG. 1, is comprised of a plurality of wheels arranged in a line. The wheels for in-line roller skate commonly have a smoothly curved periphery (see FIG. 3). This design diminishes the contact area between the wheels and the ground. Because the wheels of the in-line roller skate are arranged on a wheel frame in a line, the in-line roller skate can be moved at a high speed. However, this design cannot make the skater take a turn except the skater lifts the toe or heel. When lifting the toe or heel, users must pay attention in order to keep the body in balance. Furthermore, because the wheel frame of a in-line roller skate is a solid frame, a single wheel receives much torque when the skater deflects the roller skate. So the wheel of a in-line roller skate wears quickly with use. Therefore, this conventional in-line roller skate is not durable in use. FIG. 4 shows another structure of roller slate according to the prior art. This structure of roller skate comprises a sole plate fixedly mounted on the sole of the boot thereof to hold a rear wheel and a heel stop (brake pad). A bolt is raised from the sole plate near its front side to hold a bearing and a wheel spring holder. The wheel spring holder has two side lugs. A spherical wheel is coupled between the side lugs on the wheel spring holder. This structure of roller skate allows the skater to freely switch the skating direction. However, it is difficult to keep the roller skate in balance when making a turn or snake skating. Therefore, this structure of roller skate is not suitable for beginners.

SUMMARY OF THE INVENTION

The present invention provides a in-line roller skate which eliminates the aforesaid drawbacks. According to one aspect of the present invention, the in-line roller skate comprises a front wheel frame and a rear wheel frame respectively pivoted to the sole of the boot thereof by rivets and arranged in a line to hold a respective pair of longitudinally aligned wheels, a brake pad selectively fastened to the front wheel frame or rear wheel frame, and two ball socket shells respectively mounted in receiving troughs on the wheel frames, the ball socket shells each holding two steel balls in close contact with the sole of the boot, enabling the wheel frames to be forced to deflect when the roller skate is tilted to change its skating direction. According to another aspect of the present invention, flanges and notches are respectively provided at the wheel frames and the sole of the boot to act against the ball socket shells and to limit the turning angle of the wheel frames about the rivets. According to still another aspect of the present invention, spring elements are provided and coupled between the boot and the wheel frames to hold the wheel frames in alignment.

DETAILED DESCRIPTION OF THE PREFERRED EMBODIMENT

Figure 1:
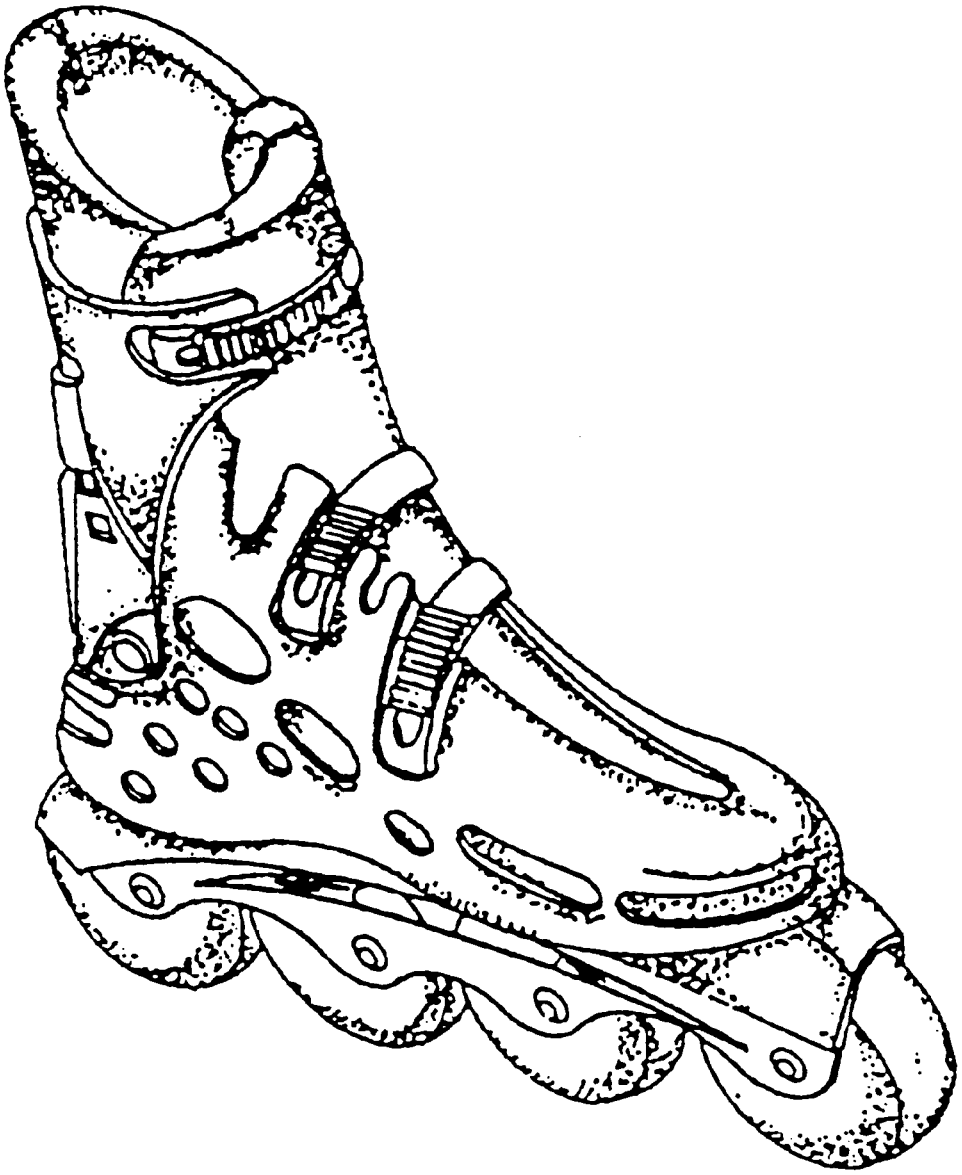
FIG. 1 PRIOR ART
FIG. 1 is a perspective view of an in-line roller skate according to the prior art.
Figure 2:
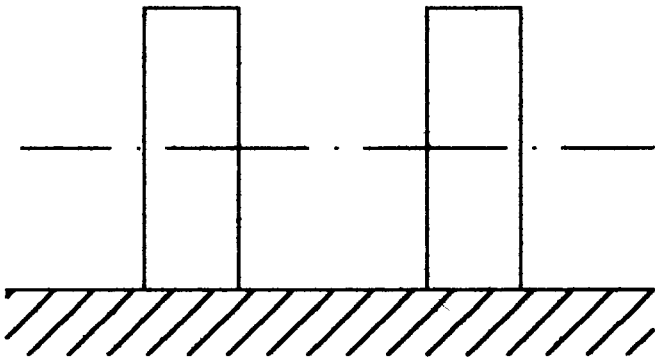
FIG. 2 PRIOR ART
FIG. 2 is a schematic drawing showing the contact between the wheels of a conventional roller skate and the ground.
Figure 3:
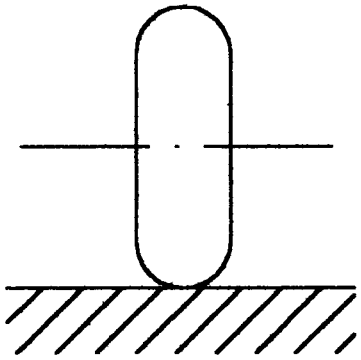
FIG. 3 PRIOR ART
FIG. 3 is a schematic drawing showing the contact between the wheels of a conventional in-line roller skate and the ground.
Figure 4:
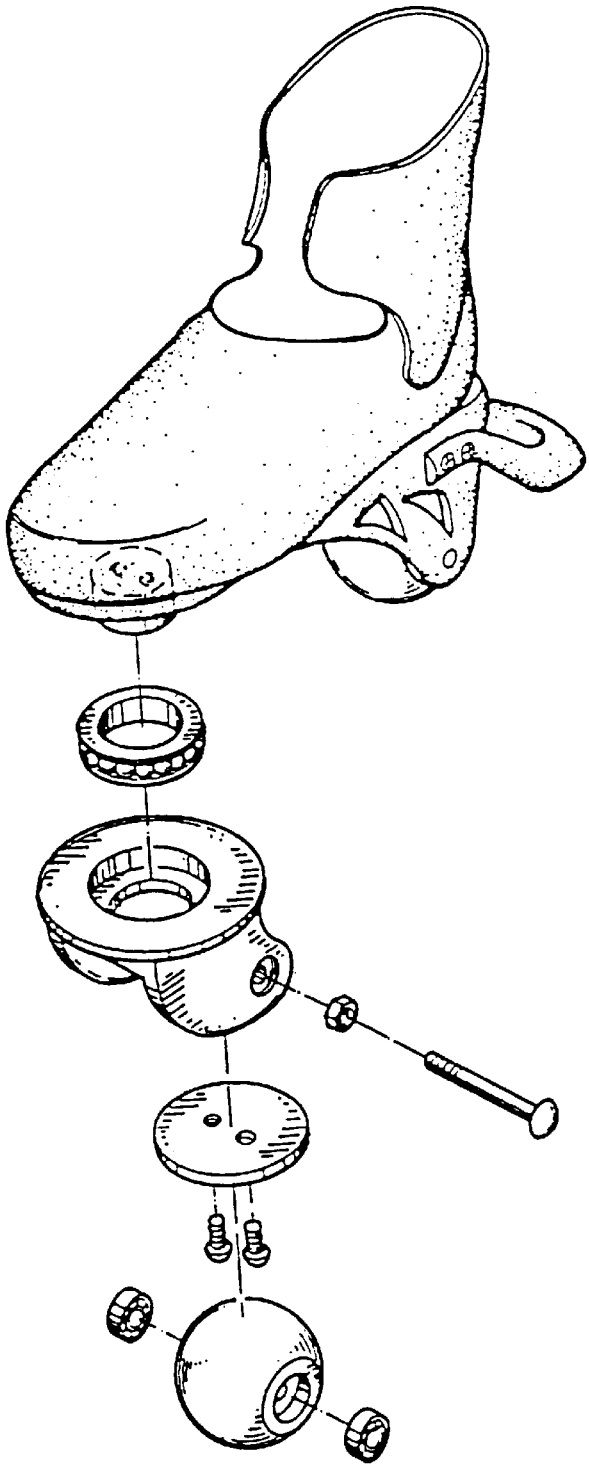
FIG. 4 PRIOR ART
FIG. 4 is an exploded view of another structure of prior art roller skate.
Figure 5:
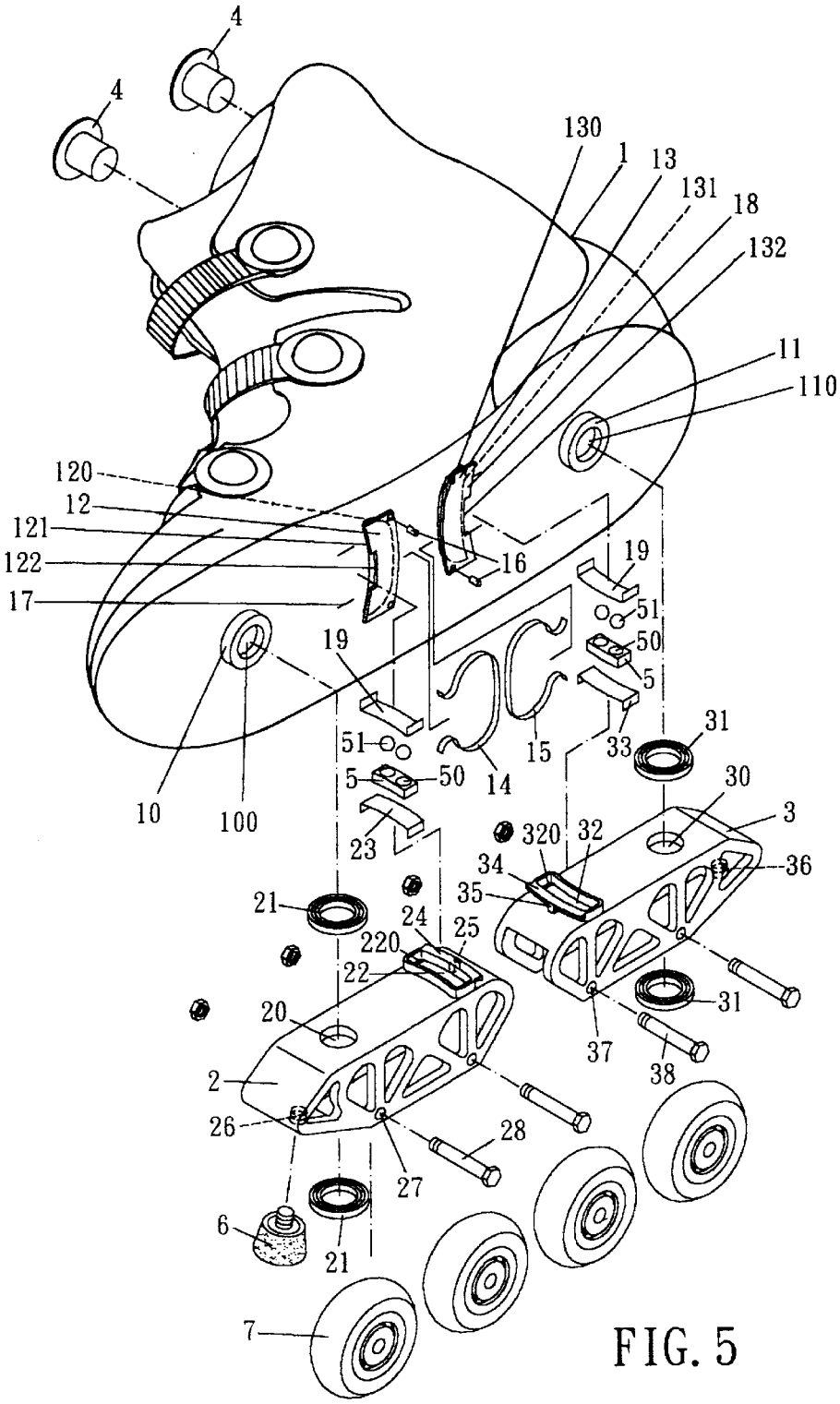
FIG. 5 is an exploded view of an in-line roller skate according to the present invention.
Figure 6:
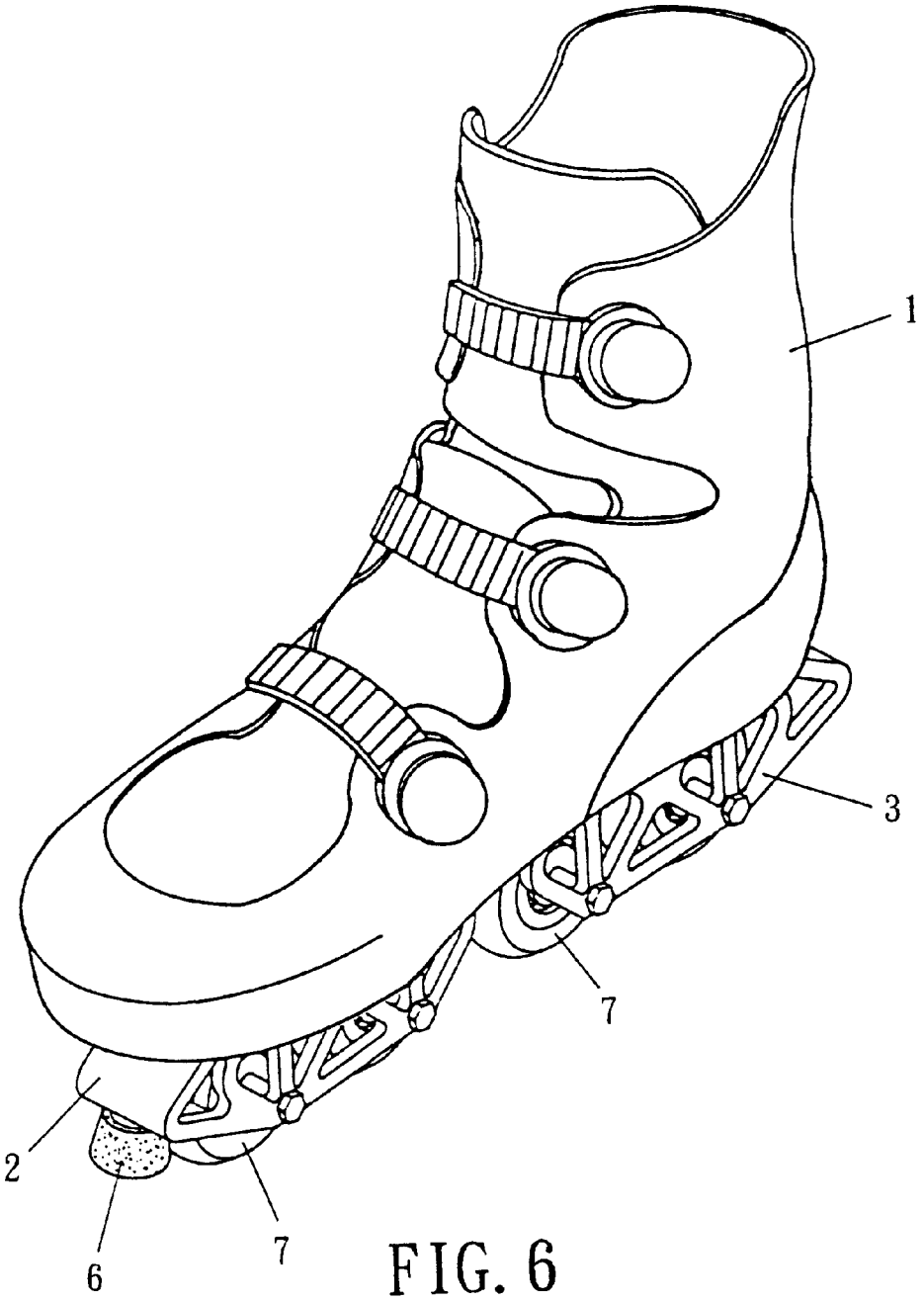
FIG. 6 is a perspective view of the in-line roller skate according to a first embodiment of the present invention.

Referring to FIG. 5, an in-line roller skate in accordance with the present invention is generally comprised of a boot 1, a front wheel frame 2, a rear wheel frame 3, two rivets 4, two ball socket shells 5, a brake pad 6, and four wheels 7.

The boot 1 is injection-molded from plastics, comprising a front stud 10 and a rear stud 11 raised from the sole, a first through hole 100 at the front stud 10 through the sole, a second through hole 110 at the rear stud 11 through the sole, a first spring holder 12 integral with the sole between the front stud 10 and the rear stud 11, the first spring holder 12 comprising a recess 120, a mounting groove 121 and a notch 122, a second spring holder 13 integral with the sole between the first spring holder 12 and the rear stud 11, the second spring holder 13 comprising a recess 130, a mounting groove 131 and a notch 133, two spring elements 14;15 respectively mounted in the recesses 120;130, two pairs of locating pins 16 respectively mounted in the recesses 120;130 at two opposite ends to secure the ends of the spring elements 14;15 in place, two pairs of locating slots 17;18 formed at the sole and respectively spaced between the studs 10;11 and the spring holders 12;13, and two metal plates 19 each having two ends respectively fastened to the locating slots 17;18. The wheel frames 2;3 are injection-molded from plastics, and fixedly fastened to the sole of the boot 1 by the rivets 4, and longitudinally arranged in a line. Each wheel frame 2 or 3 comprises a through hole 20 or 30 connected to the first through hole 100 or second through hole 110 on the boot 1 by the respective rivet 4, a pair of thrust ball bearings 21 or 31 mounted around the respective rivet 4 and disposed at two opposite ends of the through hole 20 or 30, a receiving trough 22 or 32 is mounted at the top near one end, a coupling flange 24 or 34 raised along one side of the receiving trough 22 or 32, a projecting block 25 or 35 at one end of the coupling flange 24 or 34, two retaining holes 220 or 320 provided in the receiving trough 22 or 32 at two opposite ends, a metal plate 23 or 33 mounted in the receiving trough 22 or 32, the metal plate 23 or 33 having two opposite ends respectively fastened to the retaining holes 220 or 230, a screw hole 26 or 36 at the bottom near one end, and two transverse axle holes 27 or 37, and two bolts 28 or 38 respectively mounted in the transverse axle holes 27 or 37 to hold the respective pair of wheels 7 in a line. The rivets 4 are respectively fastened to the through holes 100;110 on the boot 1 and the through holes 20;30 on the wheel frames 2;3 to secure the wheel frames 2;3 to the boot 1, enabling the wheel frames 2;3 to be turned about the rivets 4 leftwards or rightwards. The ball socket shells 5 are respectively mounted in the receiving troughs 22;32. Each ball socket shell 5 has two ball holes 50, and two steel balls 51 mounted in the ball holes 50 and peripherally projecting out of the ball holes 50 from the ends of the ball holes 50 and retained in close contact with the metal plates 19;23;33. The steel balls 51 can bear the pressure from the wheels 7 and help the front wheel frame 2 and the rear wheel frame 3 deflect under the sole of the boot. The brake pad 6 can be fastened to the screw hole 26 on the front wheel frame 2 or the screw hole 36 on the rear wheel frame 3. The wheels 7 are respectively mounted in the wheel frames 2;3 are turned about the bolts 28;38.

Figure 8:
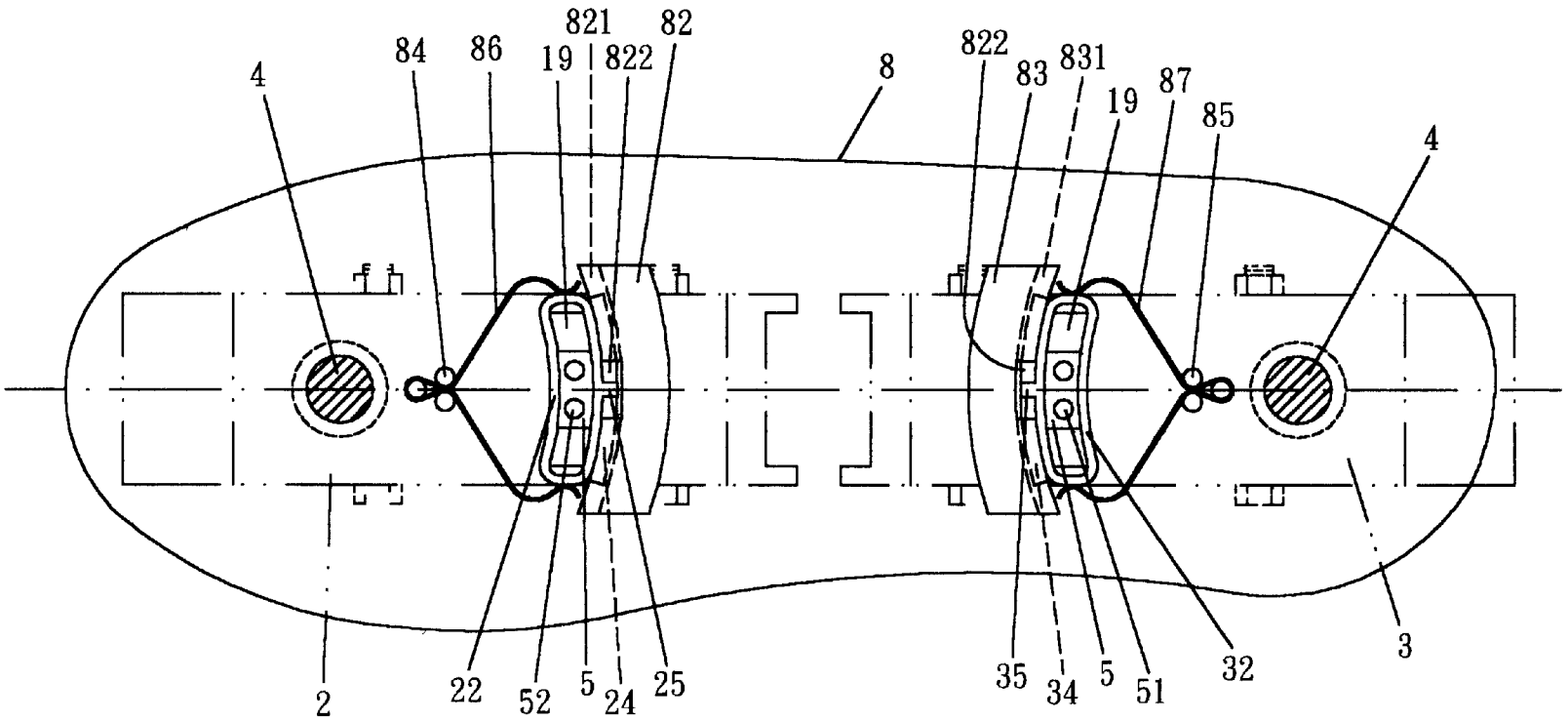
FIG. 8 is a bottom view of the in-line roller skate according to the first embodiment of the present invention.

The assembly process of the in-line roller skate is outlined hereinafter with reference to FIGS. from 5 through 7. The ball socket shells 5 with balls 51 are respectively mounted in the receiving troughs 22;32, then the front wheel frame 2 and the rear wheel frame 3 are respectively attached to the sole of the boot 1, permitting the coupling flanges 24;34 and the projecting blocks 25;35 to be forced into engagement with the mounting grooves 121;131 and notches 122;132 of the spring holders 12;13 respectively (see FIG. 8), then the spring elements 14;15 are mounted around the receiving troughs 22;32 and fastened to the spring holders 12;13 to hold the wheel frames 2;3 in alignment, and then the rivets 4 are respectively fastened to the through holes 100;110 on the boot 1 and the through holes 20;30 on the wheel frames 2;3 to secure the wheel frames 2;3 and the boot 1 together and at the same time the thrust ball bearings 21 are respectively mounted around the rivets 4 and retained at top and bottom sides of the wheel frames 2;3, and then the wheels 7 are respectively fastened to the front wheel frame 2 and the rear wheel frame 3 by the bolts 28;38, and then the brake pad 6 is fastened to the screw hole 26 on the front wheel frame 2 or the screw hole 36 on the rear wheel frame 3.

Figure 7:
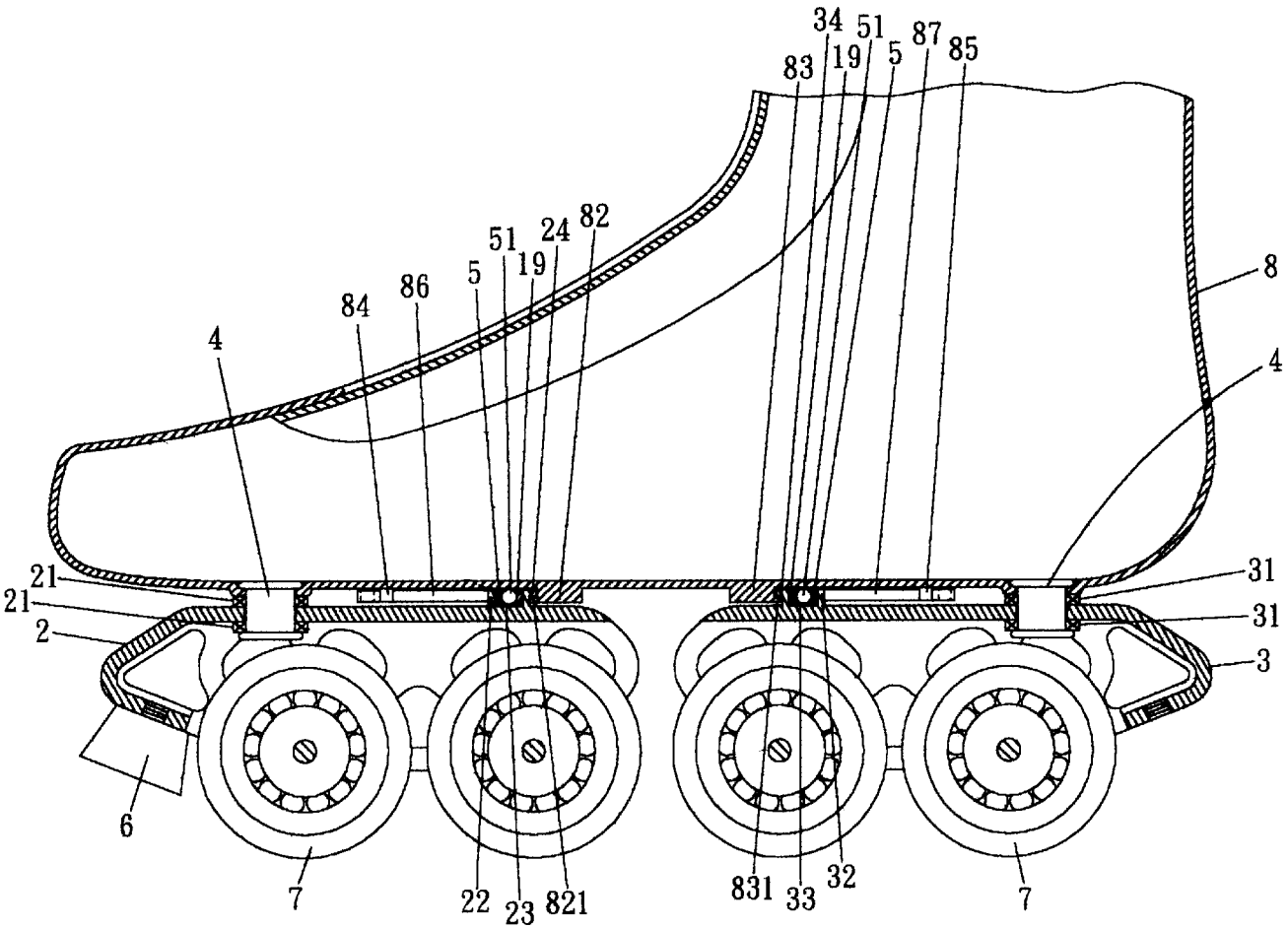
FIG. 7 is a sectional view of the in-line roller skate according to the first embodiment of the present invention.
Figure 9:
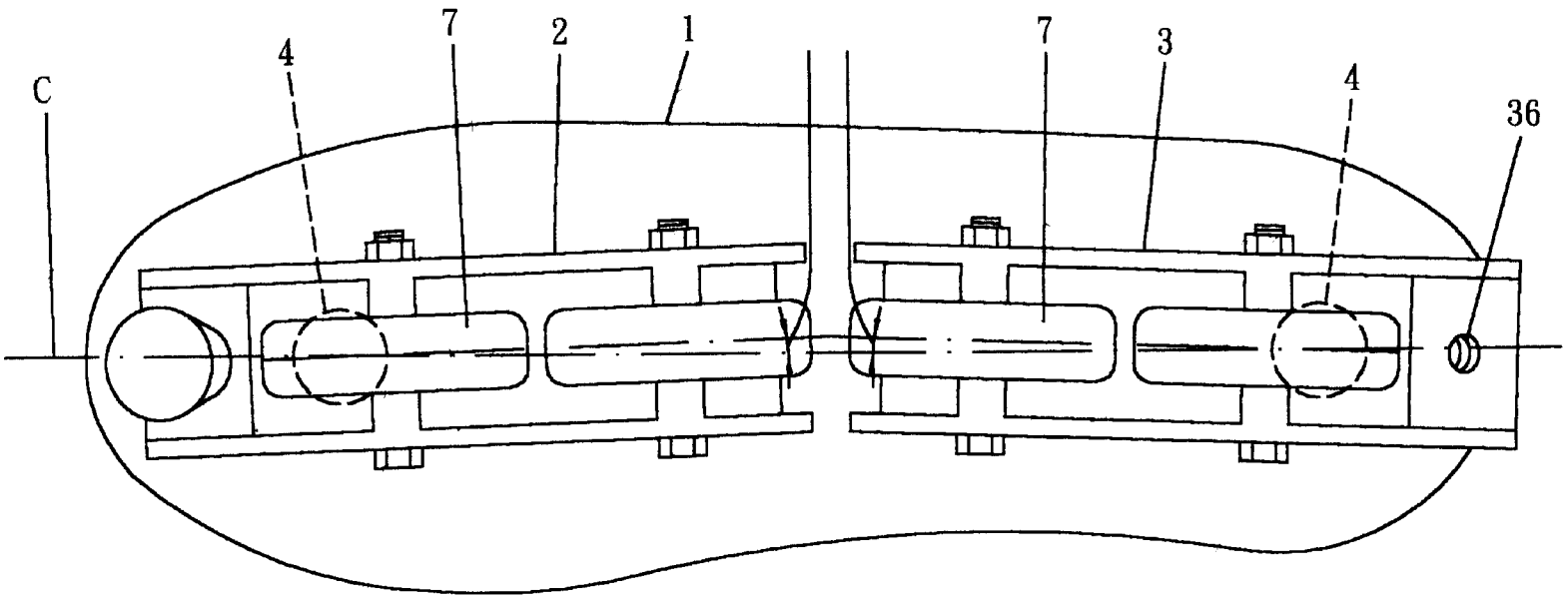
FIG. 9 is a schematic drawing of the present invention, showing the front wheel frame and the rear wheel frame deflected.
Figure 10:
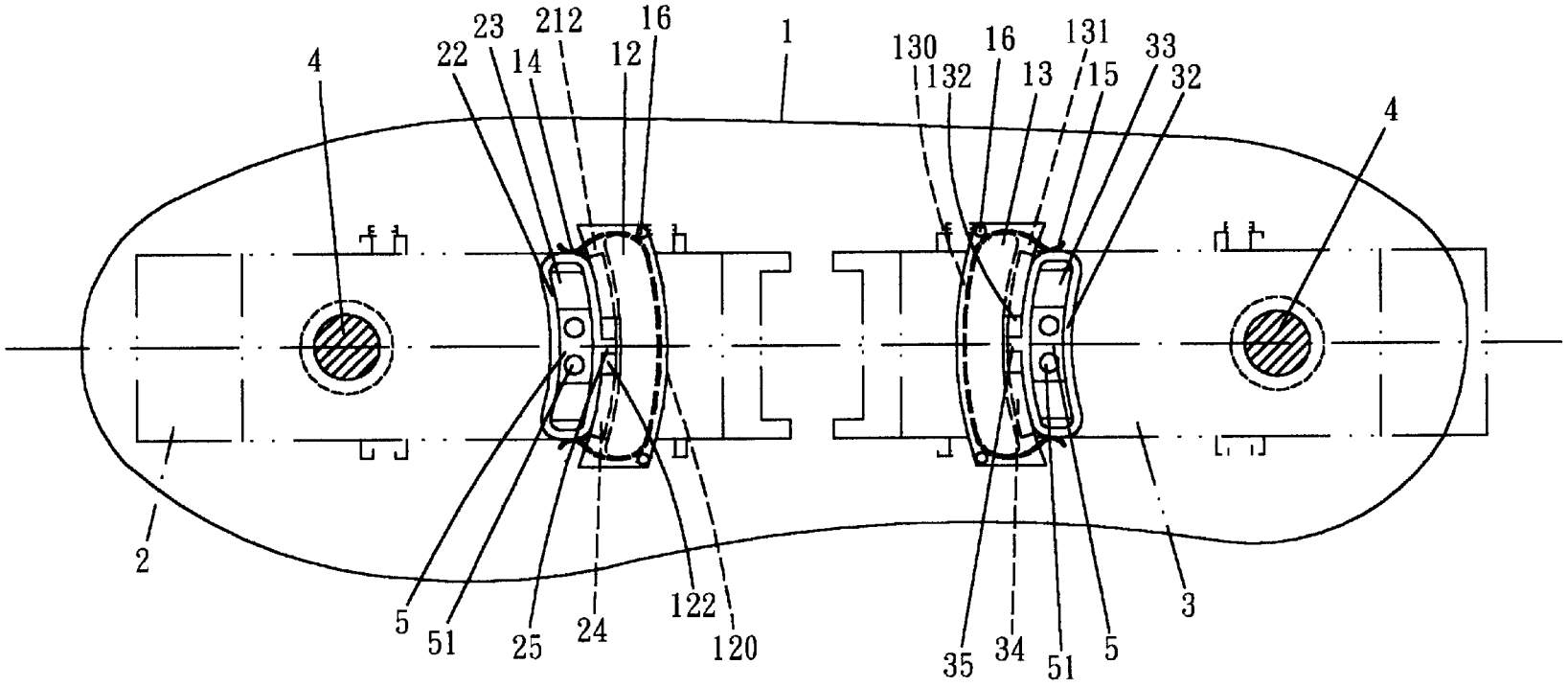
FIG. 10 is similar to FIG. 8 but showing the spring elements stretched.

Referring to FIGS. from 8 through 10 and FIG. 7 again, when the user skates straightway forwards, the four wheels 7 are longitudinally aligned. When making a turn or changing the skating direction, the roller skate is slightly tilted leftwards or rightwards subject to the desired direction, thereby causing the wheels 7 to deviate from the longitudinal central line C at an angle θ (see FIG. 9), and therefore the wheels 7 are moved forwards along a curve line. When the wheels 7 are forced to deviate from the longitudinal central line C, the spring elements 14;15 are stretched by the receiving troughs 22;32 of the wheel frames 2;3 to expand. The angle of deviation is controlled by the tilting angle of the roller skate and the constraint of the projecting blocks 25;35 and the notches 122;132 (see FIG. 10). When the tilting force is released from the roller skate, the steel balls 51 are rotated in the respective ball holes 50 between the metal plates 19;23;33, enabling the wheel frames 2;3 to be deviated from the longitudinal central line C smoothly. Because the steel balls 51 are rotatably retained between the metal plates 19;23;33, the rotation of the steel balls 51 does not damage the surface of the sole of the boot 1 and the wheel frames 2;3. When the tilting force is released, the spring elements 14;15 immediately return to their former shape, and the wheels 7 are returned to the longitudinally aligned position. If the skater is going to fall when skating, the wheels 7 are automatically forced to deviate from the longitudinal central line C at an angle, so as to support the skater in a balanced manner.

Further, because the wheels 7 are respectively mounted on the front wheel frame 2 and the rear wheel frame 3, the front wheel frame 2 and the rear wheel frame 3 are forced to deflect separately when the roller skate is tilted in one direction. Therefore, the front wheel frame 2 and the rear wheel frame 3 receive no torque when the skater changes the skating direction. This design greatly prolongs the service life of the in-line roller skate.

Figure 11:
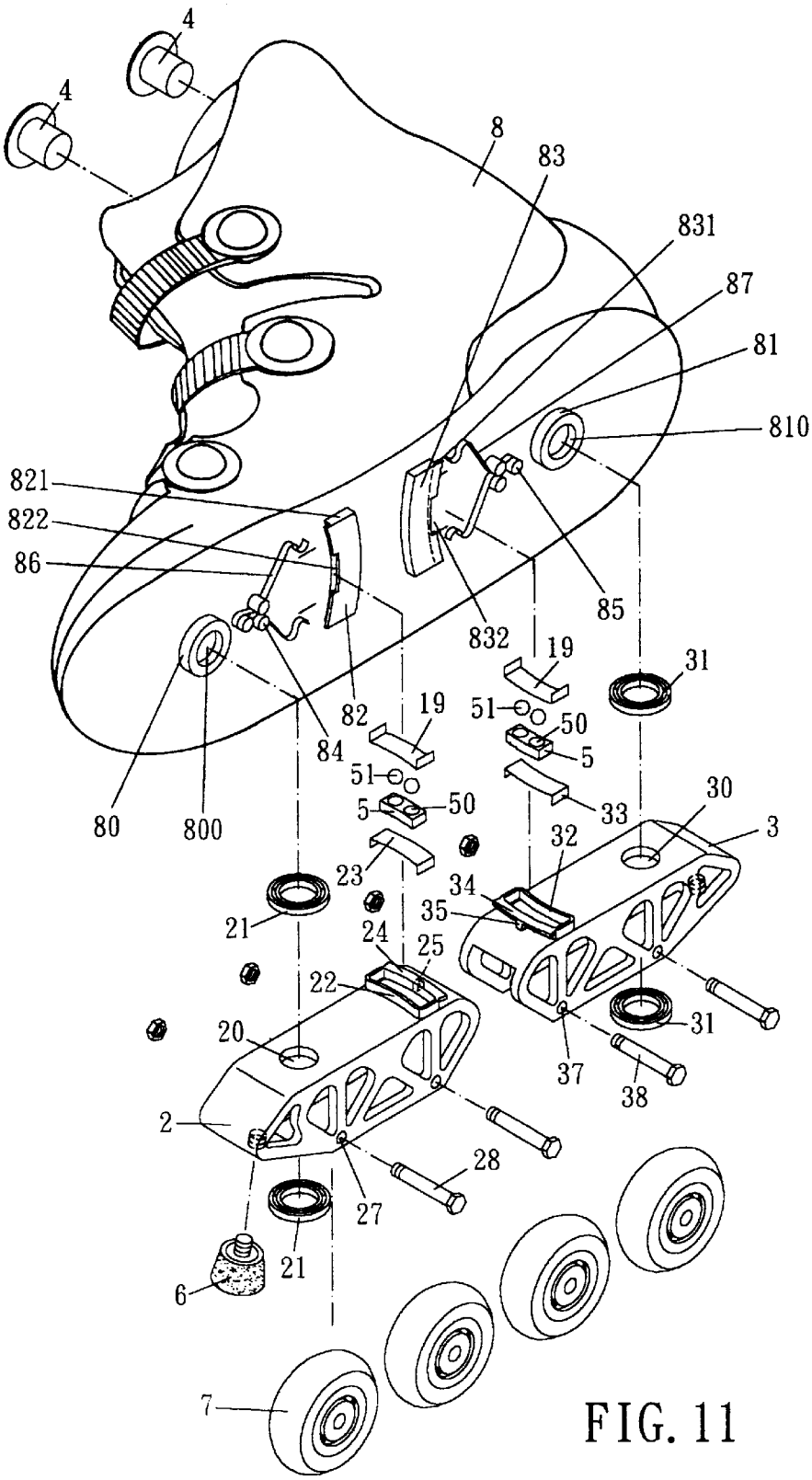
FIG. 11 is an exploded view of an in-line roller skate according to a second embodiment of the present invention.
Figure 12:
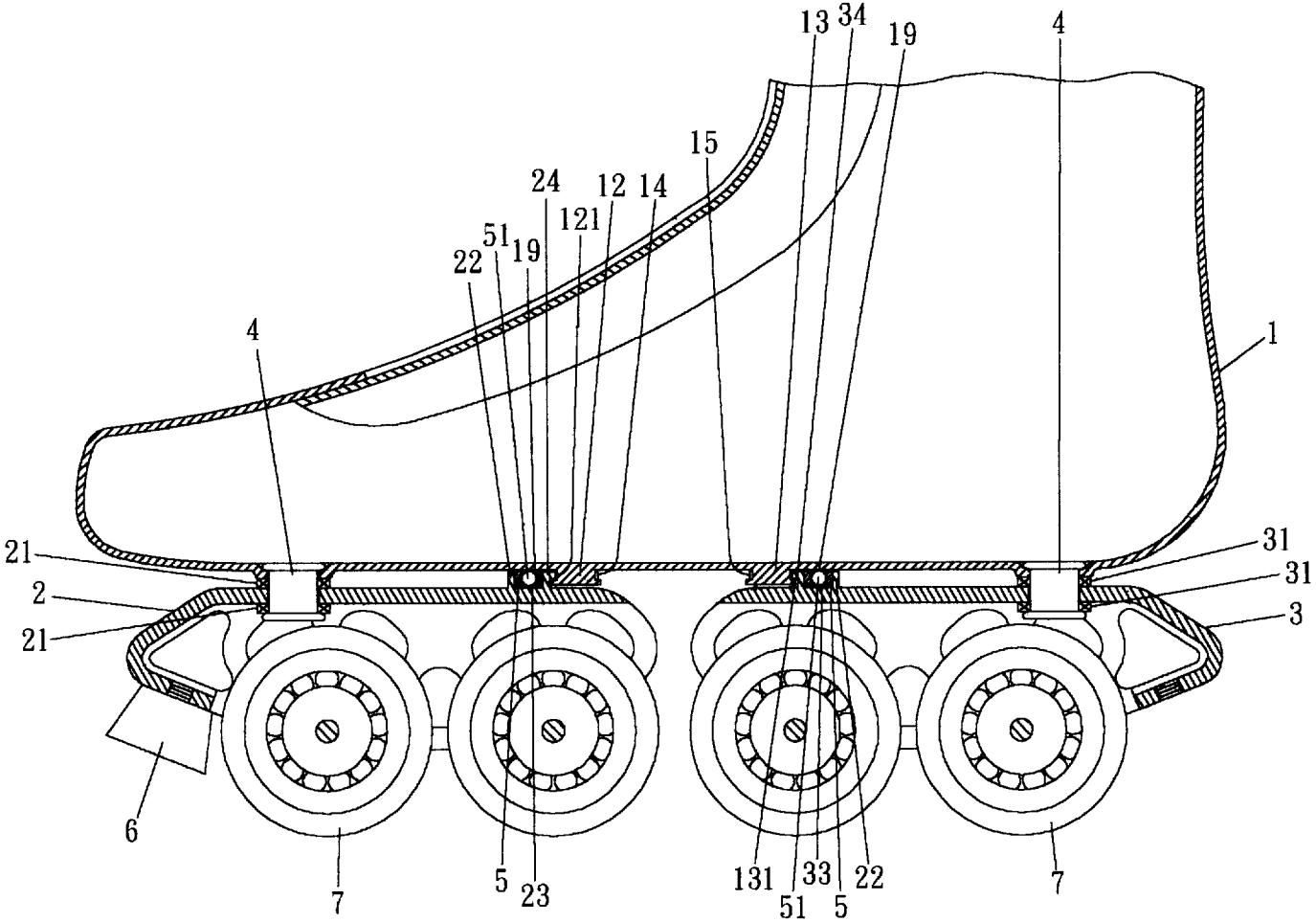
FIG. 12 is a sectional view of the in-line roller skate according to the second embodiment of the present invention.
Figure 13:
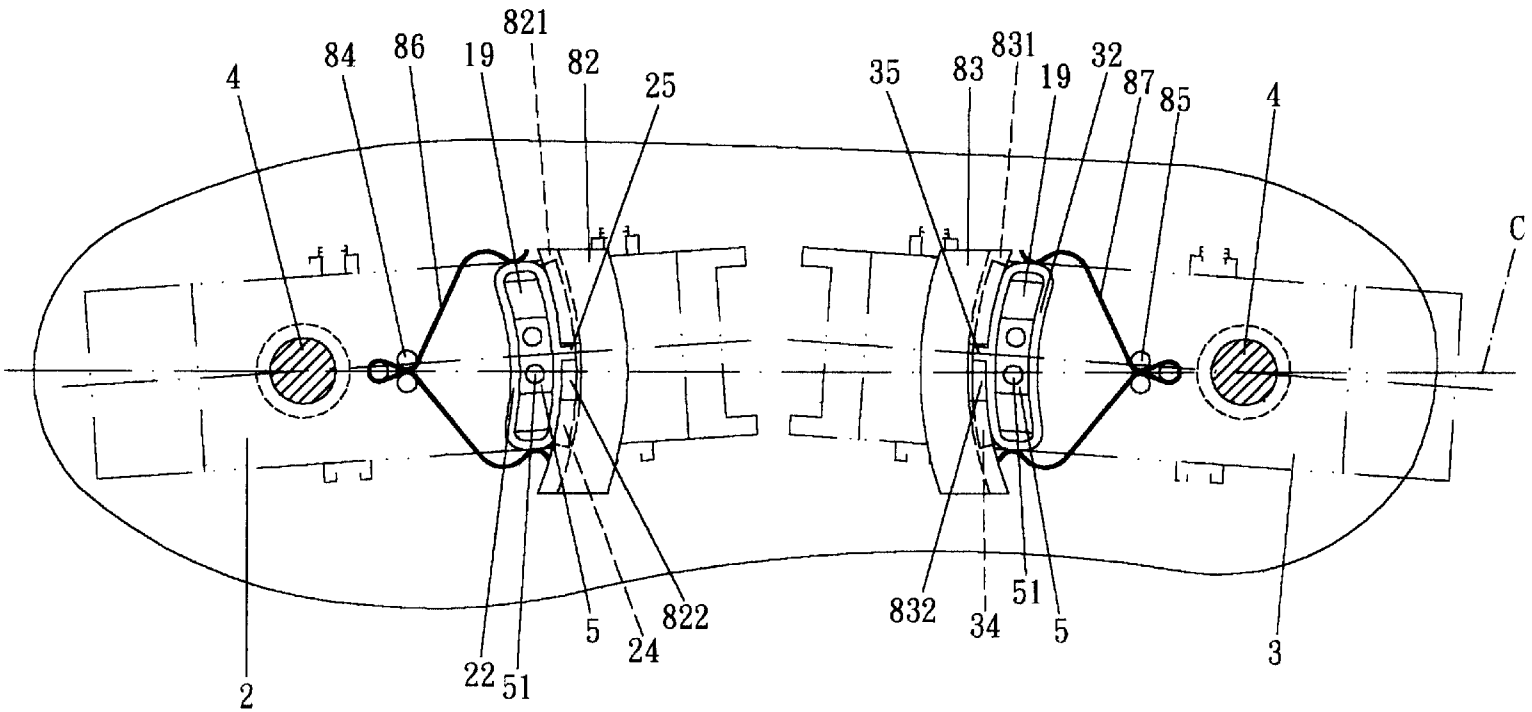
FIG. 13 is a bottom view of the in-line roller skate according to the second embodiment of the present invention.
Figure 14:
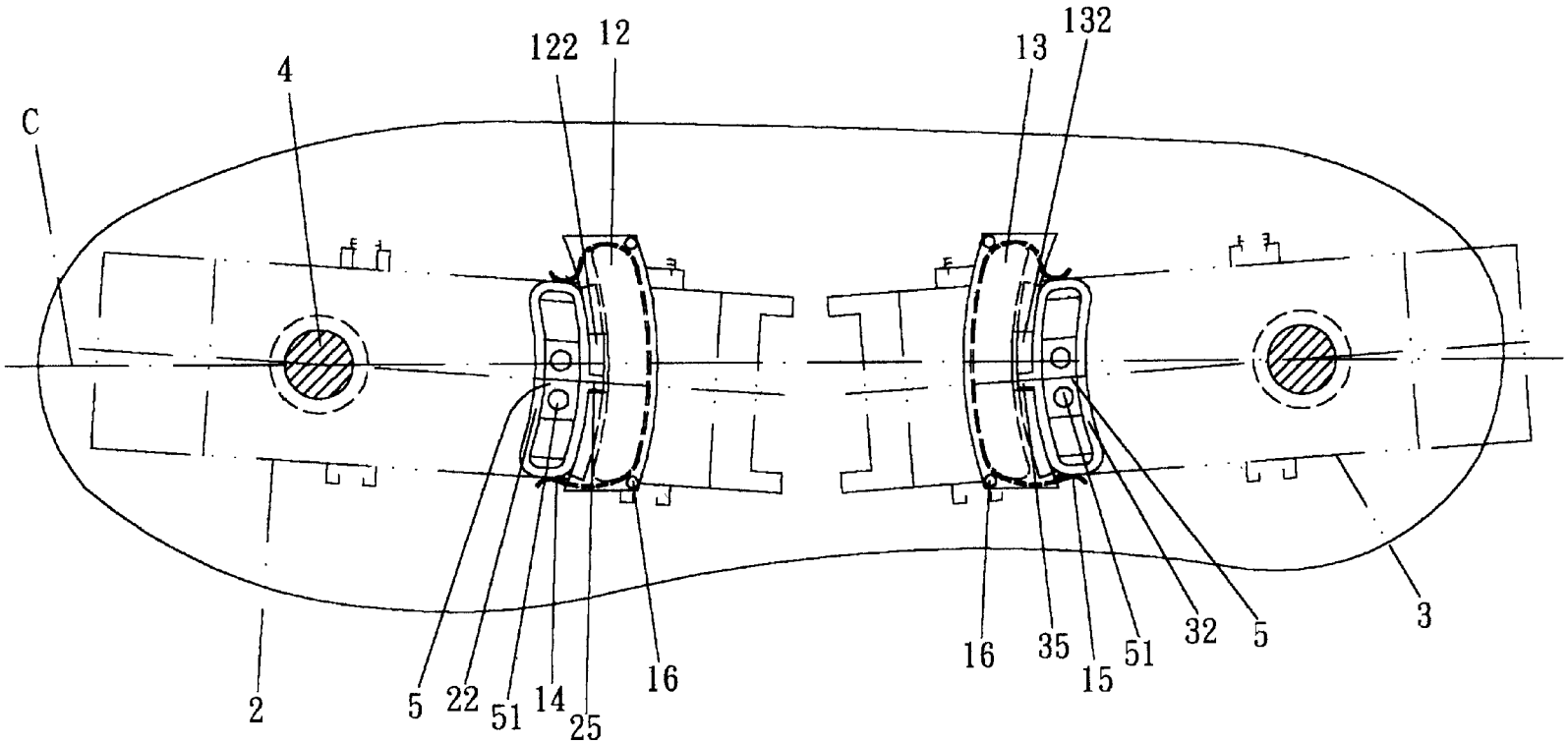
FIG. 14 is similar to FIG. 13 but showing the spring elements stretched.

FIGS.11 and 12 show an alternate form of the present invention. According to this alternate form, the boot 8 has two holders 82;83 integral with the sole between the studs 80;81. The holders 82;83 each comprise a mounting groove 821;831 and a notch 822;832. Two sets of locating rods 84;85 are raised from the sole of the boot 8 and respectively spaced between the studs 80;81 and the holders 82;83. Two spring elements 86;87 are respectively fastened to the locating rods 84;85, each having two opposite ends respectively clamped on opposite ends of the receiving troughs 22;32 (see FIGS. 13 and 14). The operation of this alternate form is similar to the aforesaid first embodiment of the present invention.

What I claim is:

1. An in-line roller skate comprising a boot, a front wheel frame, a rear wheel frame, two rivets, two pairs of thrust ball bearings, two ball socket shells, a brake pad, and four wheels, said boot comprising two studs raised from a sole thereof near front and rear ends, and two through holes respectively defined in said studs through the sole, said rivets being respectively fastened to the through holes on the studs of said boot to secure said front wheel frame and said rear wheel frame to said boot, said front wheel frame and said rear wheel frame being respectively fastened about said rivets, each having a through hole which receives the respective rivet, said thrust ball bearings being respectively mounted around said rivets and retained at top and bottom sides of said front wheel frame and said rear wheel frame, said front wheel frames and said rear wheel frame each having two transverse bolts arranged in parallel, and each frame having a bottom screw hole at one end for holding said brake pad, said wheels respectively rotating turned about the transverse bolts on said front wheel frame and said rear wheel frame and arranged in a line, said brake pad being selectively fastened to the bottom screw hole on said front wheel frame or said rear wheel frame, wherein:

said boot comprises two holders integral with the sole and spaced between said studs, said holders each comprising a recess, a mounting groove and a notch, two spring elements respectively mounted in the recesses of said holders, two pairs of locating pins respectively mounted in the recesses of said holders at two opposite ends to secure ends of said spring elements in place, two pairs of locating slots formed at the sole and respectively spaced between said studs and said holders, and two metal plates each having two ends respectively fastened to the locating slots; said wheel frames each comprise a receiving trough at a top side near one end respectively coupled to said spring elements, a coupling flange raised along one side of said receiving trough and respectively coupled to the mounting grooves on said holders of said boot, a projecting block at one end of said coupling flange respectively coupled to the notches on said holders of said boot to limit the turning angle of said front wheel frame and said rear wheel frame relative to said boot, and a ball socket shell mounted in said receiving trough, said ball socket shell having two ball holes, and two steel balls respectively mounted in said ball holes and peripherally projecting out of said ball holes from two opposite ends and retained in close contact with the sole of said boot to bear the pressure from said wheels, allowing the respective wheel frame to slightly flex with movement of the sole of said boot while on the foot of the user.

2. The in-line roller skate of claim 1 further comprising two first metal plates respectively mounted in the recesses of said holders and stopped at said steel balls of said ball socket shells at a top side, and two second metal plates respectively mounted in the receiving troughs of said front wheel frame and said rear wheel frame, and stopped at said steel balls of said ball socket shells at a bottom side.

3. A in-line roller skate comprising a boot, a front wheel frame, a rear wheel frame, two rivets, two pairs of thrust ball bearings, two ball socket shells, a brake pad, and four wheels, said boot comprising two studs raised from a sole thereof near front and rear ends and two through holes respectively defined in said studs through the sole, said rivets being respectively fastened to the through holes on the studs of said boot to secure said front wheel frame and said rear wheel frame to said boot, said front wheel frame and said rear wheel frame being respectively fastened about said rivets, each having a through hole which receives the respective rivet, said thrust ball bearings being respectively mounted around said rivets and retained at top and bottom sides of said front wheel frame and said rear wheel frame, said front wheel frames and said rear wheel frames each having two transverse bolts arranged in parallel, and each frame having a bottom screw hole at one end for holding said brake pad, said wheels respectively rotating about the transverse bolts on said front wheel frame and said rear wheel frame and arranged in a line, said brake pad being selectively fastened to the bottom screw hole on said front wheel frame or said rear wheel frame, wherein said boot comprises two holders integral with a sole thereof between said studs, said holders each comprising a mounting groove and a notch, two sets of locating rods raised from the sole and respectively spaced between said studs and said holders, two spring elements respectively fastened to said locating rods, each having two opposite ends respectively clamped on said front wheel frame and said rear wheel frame; said wheel frames each comprise a receiving trough at a top side near one end respectively secured to said spring elements, a coupling flange raised along one side of said receiving trough and respectively coupled to the mounting grooves on said holders of said boot, a projecting block at one end of said coupling flange respectively coupled to the notches on said holders of said boot to limit the turning angle of said front wheel frame and said rear wheel frame relative to said boot, and a ball socket shell mounted in said receiving trough, said ball socket shell having two ball holes, and two steel balls respectively mounted in said ball holes and peripherally projecting out of said ball holes from two opposite ends and retained in close contact with the sole of said boot to bear the pressure from said wheels, allowing the respective wheel frame to slightly step with movement of the sole of said boot while on the foot of the user.

* * * * *